US006343955B2

(12) United States Patent
Billman et al.

(10) Patent No.: US 6,343,955 B2
(45) Date of Patent: Feb. 5, 2002

(54) ELECTRICAL CONNECTOR WITH GROUNDING SYSTEM

(75) Inventors: Timothy B. Billman, Dover; John H. Weaver, Jr., Marietta, both of PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/901,819

(22) Filed: Jul. 10, 2001

Related U.S. Application Data

(62) Division of application No. 09/537,502, filed on Mar. 29, 2000.

(51) Int. Cl.[7] ..... H01R 13/648
(52) U.S. Cl. ..... 439/608; 439/101
(58) Field of Search ..... 439/101, 608, 439/857, 92, 748, 856, 862, 108

(56) References Cited

U.S. PATENT DOCUMENTS 4,571,014 A * 2/1986 Robin et al. ..... 339/143
4,824,383 A * 4/1989 Lemke ..... 439/108
4,975,084 A * 12/1990 Fedder et al. ..... 439/608
5,046,960 A * 9/1991 Fedder ..... 439/108
5,104,341 A * 4/1992 Gillissen et al. ..... 439/608
5,197,893 A * 3/1993 Morlion et al. ..... 439/101
5,429,520 A * 7/1995 Morlion et al. ..... 439/108
5,433,617 A * 7/1995 Morlion et al. ..... 439/108
5,620,340 A * 4/1997 Andrews ..... 439/108
5,795,191 A * 8/1998 Preputnick et al. ..... 439/608
RE35,896 E * 9/1998 Brunker et al. ..... 439/108
6,056,559 A * 5/2000 Olson ..... 439/108
6,083,047 A * 7/2000 Paagman ..... 439/608
6,116,926 A * 9/2000 Ortega et al. ..... 439/108
6,120,306 A * 9/2000 Evans ..... 439/101
6,129,555 A * 10/2000 Daikuhara et al. ..... 439/60

* cited by examiner

*Primary Examiner*—Gary Paumen
*Assistant Examiner*—P Nguyen
(74) *Attorney, Agent, or Firm*—Perman & Green, LLP

(57) ABSTRACT

An electrical connector comprising a housing and electrical contacts connected to the housing. The electrical contacts comprise paired signal and ground contacts, and additional ground contacts. The additional ground contacts are arranged relative to the paired contacts to divide the paired contacts into subdivisions of equal numbers of the paired contacts. The subdivisions and the additional ground contacts are arranged to allow for multiple relative orientation connections of a mating connector.

13 Claims, 15 Drawing Sheets

ELECTRICAL CONNECTOR WITH GROUNDING SYSTEM

This is a divisional application of co-pending application Ser. No. 09/537,502 filed Mar. 29, 2000, which is hereby incorporated by reference in its entirety.

BACKGROUND OF THE INVENTION

1. Field of the Invention

The present invention relates to electrical connectors and, more particularly, to an electrical connector having center ground contacts.

2. Brief Description of Earlier Developments

U.S. Pat. Nos. 5,429,520 and 5,433,617 disclose electrical connectors having a ground contact plate unit with a general cross shape and a cross-shaped receiving area in a mating electrical connector establishing four quadrants of contacts. It is also known in the connector art for two contacts in an electrical connector to transmit the same signal (but in opposite voltage), such as for high speed signals, wherein the differences between the parallel signals can be compaired or combined with any differences (e.g. noise) being removed. These are generally known as a "differential pair" of contacts. A "single ended" contact generally refers to a single signal contact surrounded by a ground (e.g. a coaxial conductor or pseudo-coaxial arrangement). It is desired to provide electrical connectors with contacts arranged in a symmetrical mating pattern which allows a first connector to be mated with a second connector in various orientations, such as 90° apart. A problem exists with conventional electrical connectors in that they do not allow common electrical connector parts to be used in the manufacture of both an electrical connector with only single ended signal contacts and an electrical connector with both differential pair contacts and single ended contacts. It is also desired to provide differential pair and single ended contact arrangements which can use common manufacturing parts as used to manufacture the electrical connectors having only single ended contacts. A problem exists with conventional electrical connectors in that they do not allow differential pair and single ended contact arrangements to be configurable into different patterns. It is also desired to allow differential pair and single ended contact arrangements to be configurable into different patterns.

SUMMARY OF THE INVENTION

In accordance with one embodiment of the present invention, an electrical connector is provided comprising a housing and electrical contacts connected to the housing. The electrical contacts comprise paired signal and ground contacts, and additional ground contacts. The additional ground contacts are arranged relative to the paired contacts to divide the paired contacts into subdivisions of equal numbers of the paired contacts. The subdivisions and the additional ground contacts are arranged to allow for multiple relative orientation connections of a mating connector.

In accordance with another embodiment of the present invention, an electrical connector is provided comprising subassembly wafers and a ground plane member. At least two of the wafers comprise a housing, paired signal and ground contacts, and an additional ground contact in a general center of a connection area for the paired contacts. The ground plane member is located between at least two of the wafers. The ground plane member has contact areas located between at least some of the paired contacts of one of the at least two wafers and at least some of the paired contacts of the other one of the at least two wafers.

In accordance with another embodiment of the present invention, an electrical connector is provided comprising paired signal and ground contacts; additional ground contacts located between at least some of the paired contacts; and a housing having first contact receiving areas with the paired contacts located therein and second contact receiving areas with the additional ground contacts located therein. At least one of the second contact receiving areas does not contain an additional ground contact such that two of the paired contacts on opposite sides of the at least one second contact receiving area form a differential pair of contacts for high speed differential pair signal transmission.

In accordance with one method of the present invention, a method of manufacturing an electrical connector is provided comprising steps of providing a housing having first contact receiving areas and second contact receiving areas; positioning paired signal and ground contacts in the first contact receiving areas; and positioning additional ground contacts in the second contact receiving areas. At least one of the second contact receiving areas does not have an additional ground contact located therein such that two of the paired contacts on opposite sides of the at least one second contact receiving area form a differential pair of high speed signal transmission contacts.

In accordance with another embodiment of the present invention, an electrical connector is provided comprising a first subcomponent wafer assembly comprising a first housing and single ended signal and respectively paired ground contacts connected to the first housing; and a second subcomponent wafer assembly connected to the first subcomponent wafer assembly. The second subcomponent wafer assembly comprises a second housing and, connected to the second housing, pairs of differential pair signal contacts and respectively associated ground contacts for each signal contact.

In accordance with another method of the present invention, a method of manufacturing electrical connectors having both single ended signal contacts and differential pair signal contacts is provided comprising steps of providing pairs of signal contacts and respective ground contacts; and selectively locating additional ground contacts between at least two first ones of the pairs. At least two second ones of the pairs do not have the additional ground contacts therebetween such that the signal contacts of the two second pairs form a differential pair of high speed signal transmission signal contacts and signal contacts of the two first pairs form single ended signal transmission signal contacts.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
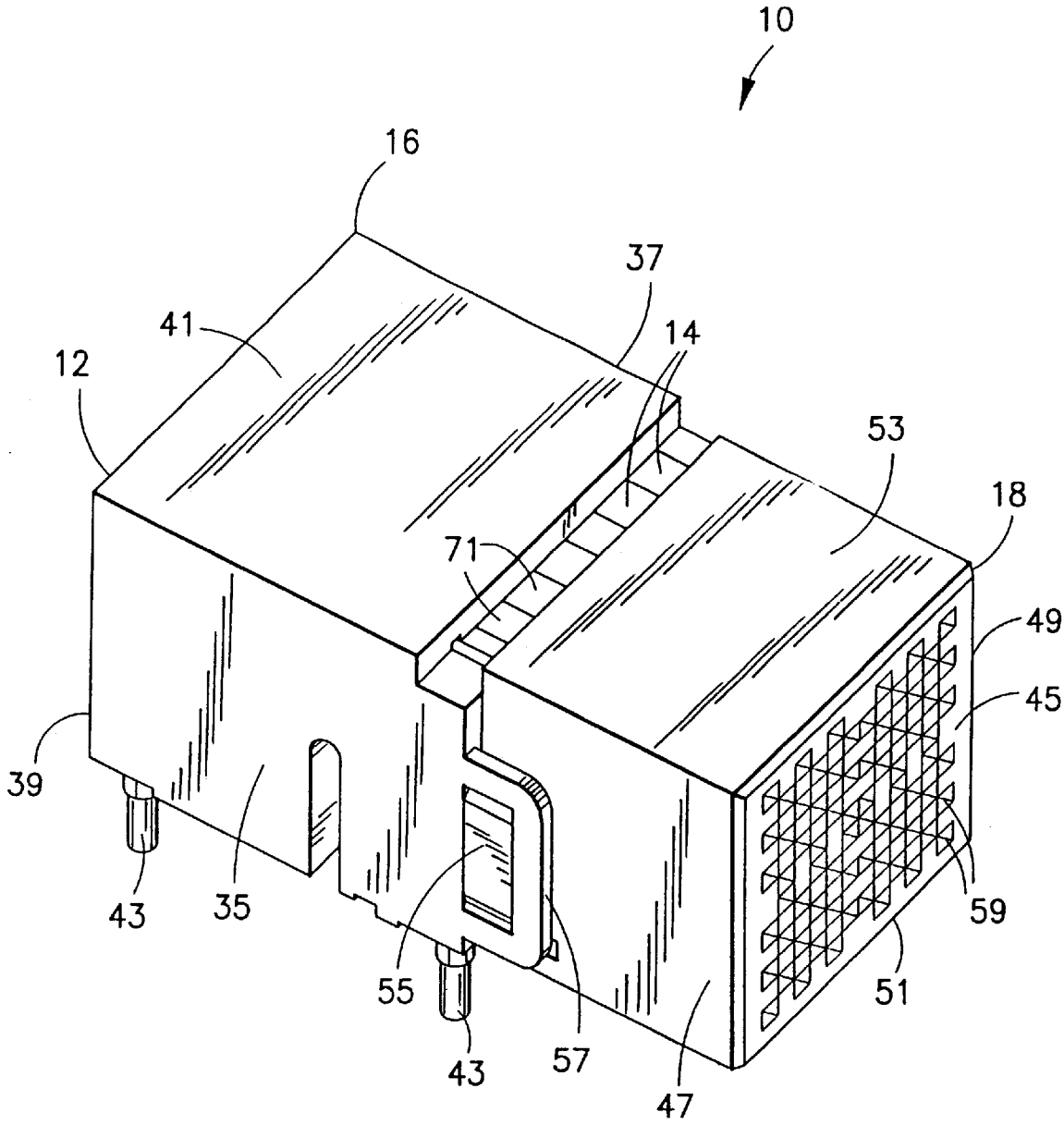
FIG. 1 is a perspective view of an electrical connector incorporating features of the present invention.

Referring to FIG. 1, there is shown a perspective view of an electrical connector 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

Figure 4:
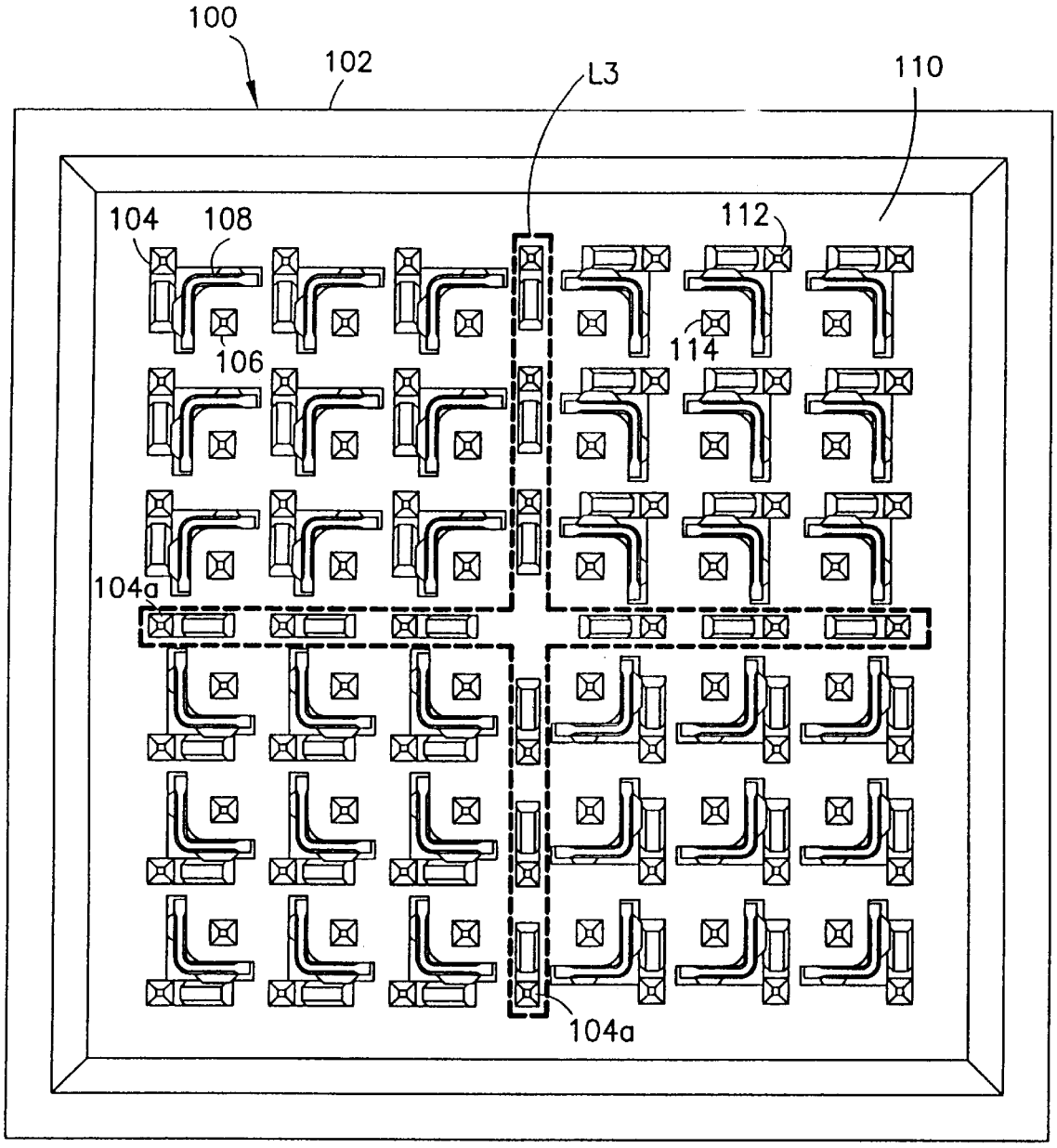
FIG. 4 is a front elevational view of a mating electrical connector for use with the connector shown in FIG. 1.

The connector 10 in this embodiment is a receptacle electrical connector adapted to be connected to a first electrical component (not shown) such as a printed circuit board and removably connectable to a mating electrical connector, such as a pin header (see FIG. 4). The connector 10 and connection system is similar to that described in U.S. provisional patent application No.: 60/117,957 filed Jan. 28, 1999 which is hereby incorporated by reference in its entirety. The connector 10 generally comprises a housing 12 and modules or subassembly wafers 14. However, in alternate embodiments more or less components can be provided. The housing 12 generally comprises a rear housing member 16 and a front housing member 18.

Figure 1A:
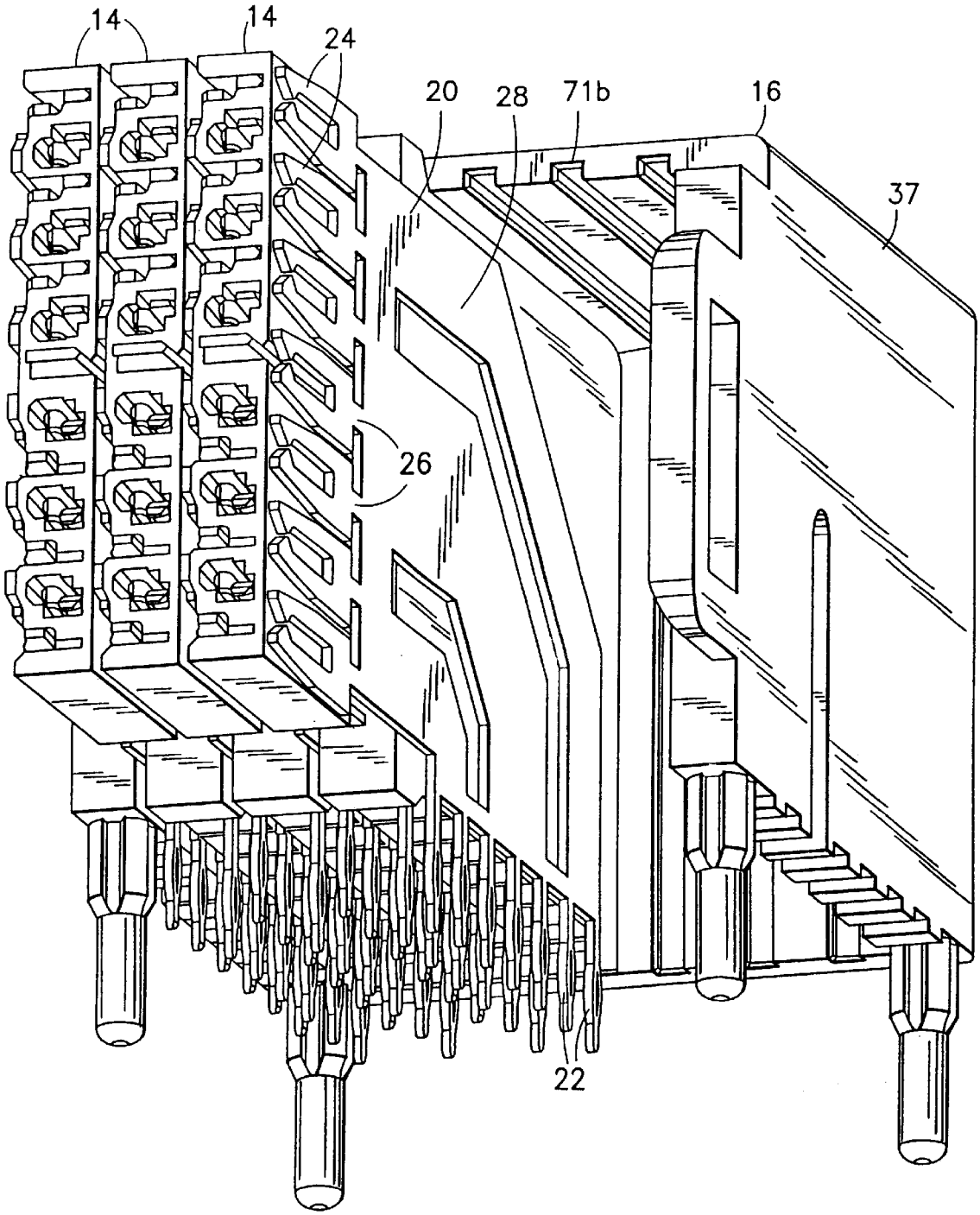
FIG. 1A is a perspective view of a portion of the connector shown in FIG. 1.

Referring also to FIG. 1A, rear housing member 16 is generally an open structure formed by sidewalls 35, 37; a rear wall 39; and a top wall 41. The open interior of rear housing member 16 receives the rear portions of a series of the modules 14 arranged side-by-side. Specifically a groove 71*b* receives a spline 71*a* to ensure proper alignment. Receptacle 10 accurately rests on a daughterboard (not shown) using alignment posts 43 extending downwardly from sidewalls 35, 37. Alignment posts 43 engage corresponding through holes in the daughterboard preferably by an interference fit.

Front housing member 18 is also generally an open structure formed by a mating face 45; sidewalls 47, 49; bottom wall 51; and top wall 53. The open interior of The front housing member 18 receives the front portions of the series of modules 14 arranged side-by-side. As with housing 16, housing 18 can have grooves (not shown) to receive another spline 71*a* on wafer 30. Front housing member 18 secures to rear housing member 16 using latch structures 55, 57 on each housing, respectively. The front housing member 18 secures to the rear housing member 16 after placement of the modules 14 within the rear housing member 16. Once assembled, receptacle 10 can mount to the daughterboard.

The mating face 45 of the front housing member 18 includes an array of lead-ins 59. Lead-ins 59 accept corresponding signal pins and ground pins from the header (See FIG. 4). Once the header mates with the receptacle 10, the signal and ground contacts of receptacle 10 engage the signal pins and ground pins of the header. This feature will be described in more detail below.

As seen in FIG. 1A, the connector 10 can include a ground plane member 20. The ground plane member 20 is a one-piece member comprised of electrically conductive material which is also ferromagnetic. In alternate embodiments the ground plane member 20 could be comprised of multiple members. In this embodiment the ground plane member 20 comprises first connection ends 22 and second connection ends 24. The first connection ends 22 comprise through-hole solder trails, but any suitable second connection ends could be provided. The second connection ends 24 comprise opposing spring contact arms forming a pin receiving area therebetween, but any suitable second connection ends could be provided. The ground plane member 20 has break-off sections 26 between the second connection ends 24 and the main body 28. The break-off sections can be severed or cut during manufacturing to remove one or more of the second connection ends 24 to customize or configure the ground place member as further understood below. However, in an alternate embodiment the break-off section needs not be provided or any suitable type of severing system could be provided.

Figure 2:
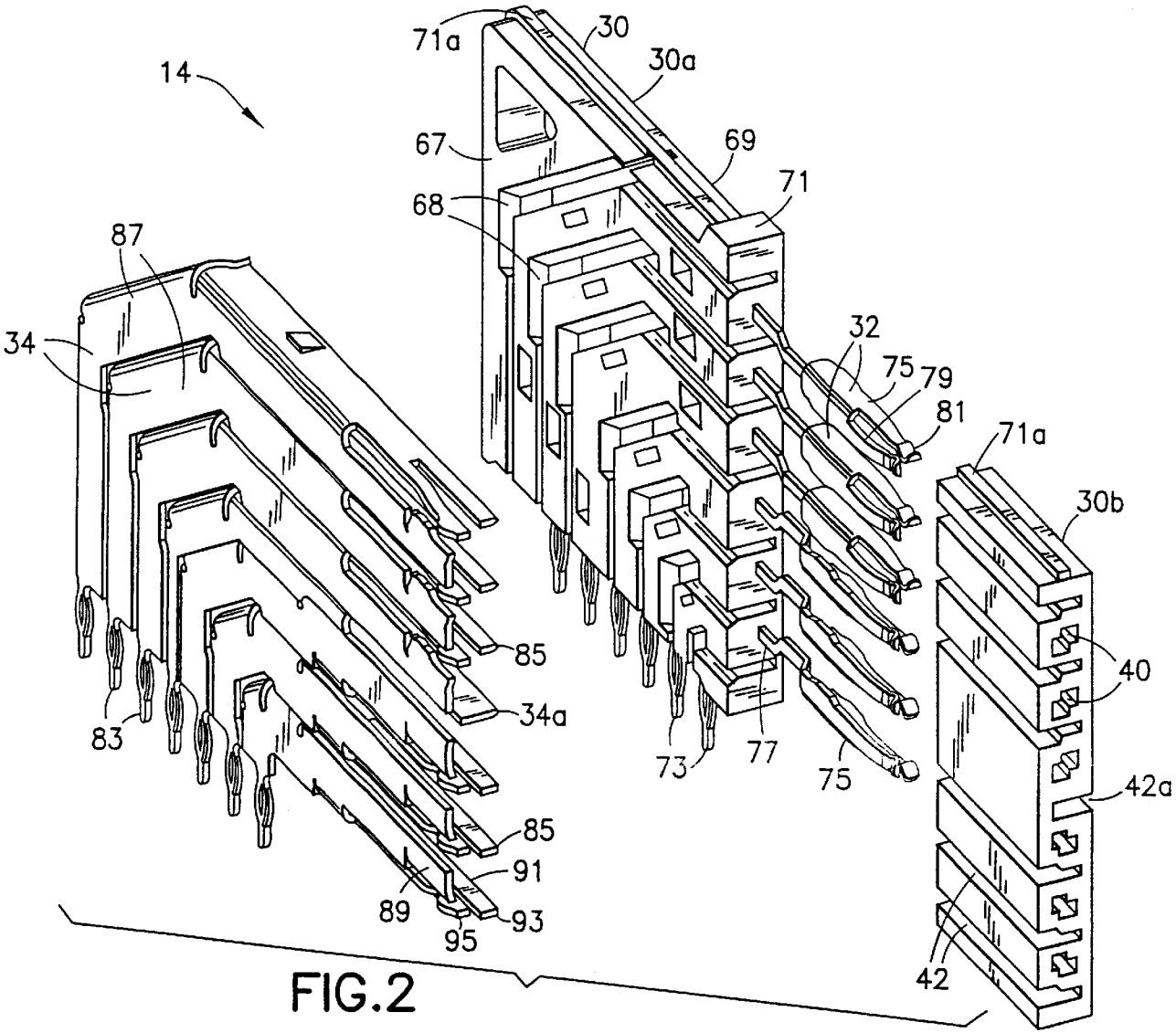
FIG. 2 is an exploded perspective view of one of the contact module assemblies shown in FIG. 1.

Referring also to FIG. 2 an exploded perspective view of one of the modules 14 is shown. Each module 14 generally comprises a frame or wafer 30, signal contacts 32 and ground contacts 34. However, in alternate embodiments, more components could be provided, and/or the component need not be provided as uniform modules. Wafer 30 can be a block of insulative material. The wafer 30 can be formed from several pieces 30*a*, 30*b*. Alternatively, however, wafer 30 could be formed unitarily from one piece (not shown). In this embodiment the module 14 comprises six signal contacts and seven ground contacts, but any suitable number of contacts could be provided. The center ground contact 34*a* may also be omitted as further understood below. A first major surface 67 of wafer piece 30*a* has a series of channels, grooves or apertures 68 in which ground contacts 34 reside. When arranging modules 14 side-by-side, first major surface 67 of a first module 14 can abut a second major surface 69 of a second adjacent module. In order to place modules 14 side-by-side, second major surface 69 can be generally featureless. The top surface of wafer piece 30*a* includes a projection 71. As seen in FIG. 1, projections 71 can abut the front edged of rear housing member 16 during, and after, assembly. The interaction between projections 71 and the front edge of rear housing member 16 helps align modules 14 within rear housing member 16. The wafer piece 30*a* can also have a spine 71*a*. The spine 71*a* can be located in a groove 71*b* in the rear housing piece 16. Signal contacts 32 include a mounting end 73 for securing to the daughterboard, a mating end 75 for interacting with signal pins of the header, and an intermediate portion 77. The mounting ends 73 can have press-fit solder tails that engage plated through holes in the daughterboard. However, other types of terminations for mounting ends 73 could be used. Typically, an overmolding process embeds signal contact 32 in wafer piece 30*a* (or wafer 30 if one piece), however, other techniques could be used. The second wafer piece 30*b* is preferably premolded and subsequently mounted over the mating ends 75 of the signal contacts 32. The second wafer piece 30*b* includes first receiving apertures 40 and second receiving apertures 42. The first receiving apertures 40 receive the mating ends 75 of the signal contacts 32. The second receiving apertures 42 receive the mating ends of the ground contacts 34. The center second receiving aperture 42*a* extends into an opposite side of the second wafer piece 30*b* than the other second receiving apertures 42, but this need not be provided. Also in this embodiment, the receiving apertures 40, 42 above the center second receiving aperture 42*a* are preferably mirror images of the receiving apertures 40,42 below the center second receiving aperture 42*a*. However, this need not be provided.

The mating end of the signal contacts 32 can have a dual beam contact configuration to engage signal pins of the header. The beams 79, 81 of the dual beam contact are arranged generally perpendicular to each other. In this arrangement, the bifurcation engages adjacent surfaces of the mating signal pins. Beams 79, 81 deflect upon insertion of the mating signal pins. The movement of signal pins along the beams 79, 81 during insertion provides good wiping action. In addition, the force imparted to the signal pins by deflection of the beams 79, 81 provides good contact pressure or contact normal force.

As with signal contacts 32 the ground contacts 34 include a mounting end 83 for securing to the daughterboard, a mating end 85 for interacting with ground pins of the mating header, and an intermediate portion 87. Mounting ends 83 can have press-fit solder tails that engage plated through holes in the daughterboard. However, other types of terminations for mounting ends 83 could be used. Mating end 85 uses a dual beam-type contact arrangement to engage ground pins of the header. Mating end 85 includes a first beam 89 arranged generally perpendicular to a second beam 91. A minor surface of first beam 89 supports the ground pin. As discussed above, the beam 89 provides good contact force and wipe. Second beam 91 is bifurcated into a stationary section 93 and movable section 95. Upon engagement of movable section 95 of second beam 91 with a ground pin, movable section 95 deflects. As with the other contacts, the deflection provides good contact force and wipe.

Signal contacts 32 within module 14, as with ground contacts 34 within module 14, preferably do not maintain the same orientation throughout the module 14. Furthermore, signal contacts 32 and ground contacts 34 in one module 14 preferably do not exhibit the same orientation as signal contacts 32 and ground contacts 34 in all of the other modules 14.

Figure 3:
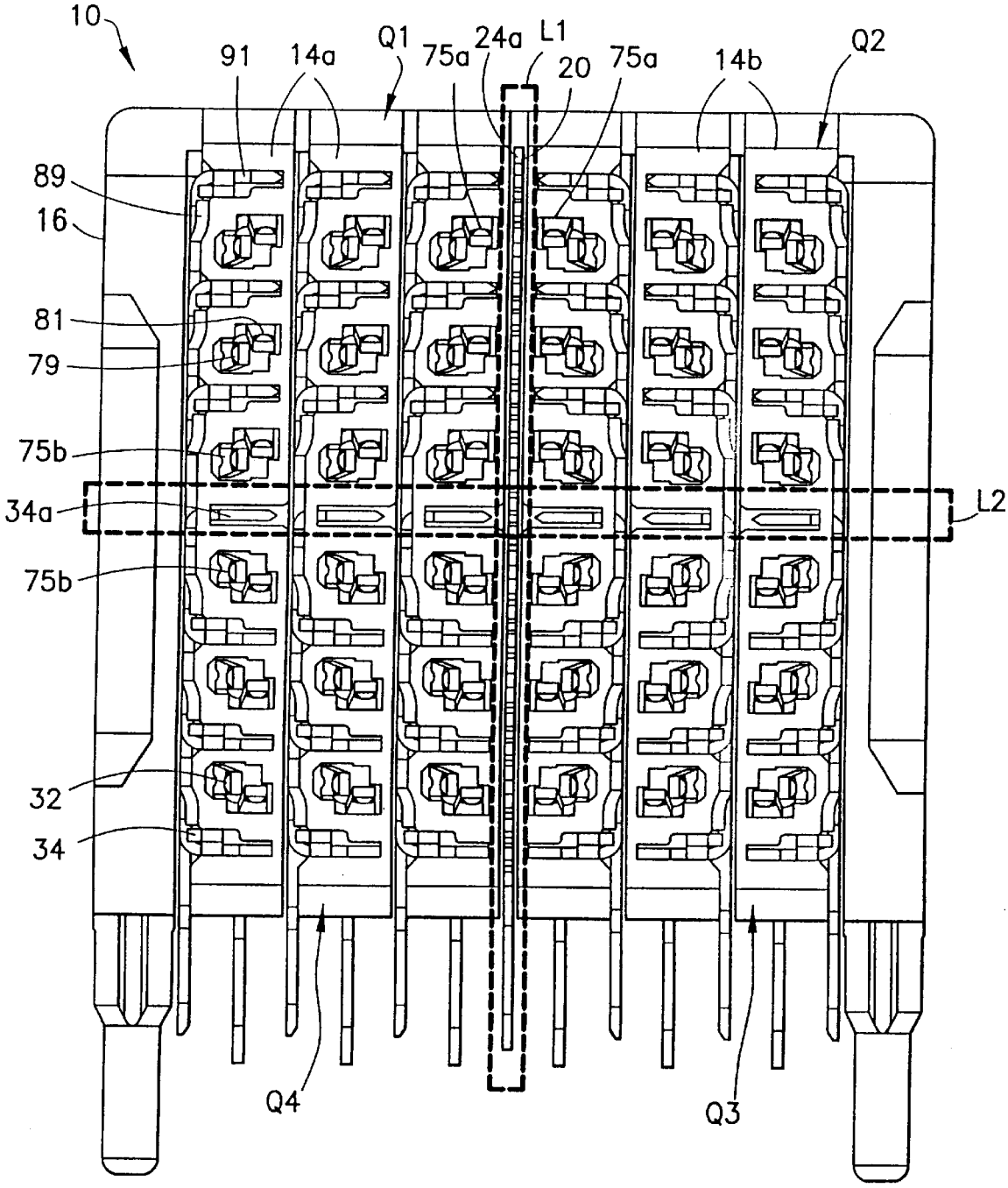
FIG. 3 is a front elevational view of the connector shown in FIG. 1 with the front housing part and certain signal contacts removed.

Referring also to FIG. 3, a front elevational view of the connector 10 is shown with the front housing member 18 removed. In this embodiment the connector 10 comprises six of the modules 14. In alternate embodiments more or less than six modules could be used. In this embodiment the six modules 14 actually comprise two types of modules 14*a*, 14*b* which are mirror images of each other. In alternate embodiments more or less than two types of modules could be provided and, the modules need not be mirror images of each other.

The general L shape of the signal contacts 32 generally correspond to the positions of the beams 79, 81. Likewise, the general L shape of the ground contacts 34 generally correspond to the positions of the beams 89, 91. Two areas L1, L2, preferably passing through a center of the receptacle 10, define four quadrants Q1, Q2, Q3, Q4. Each signal contact 32 corresponds to a ground contact 34 to form a contact pair. In the arrangement shown in FIG. 3, the signal contact 32 and ground contact 34 in each contact pair have the same orientation. In other words, signal contact 32 and ground contact 34 of contact pair face the same direction. Generally speaking, the orientation of each contact pair within a quadrant (even in a different module) remains the same. However, the orientation of contact pairs in other quadrants differ from the orientation of contact pairs in other quadrants (even on the same module). Typically, contact pairs in one quadrant are rotated 90° relative to contact pairs in an adjacent quadrant. For example, a contact pair in quadrant Q1 is rotated 90° relative to a contact pair in quadrant Q2.

Since one module 14 can have contacts 32, 34 residing in more than one quadrant, the orientation of some contacts 32, 34 in each module 14 can differ from the orientation of other contacts in the same module. Typically, contact pairs in a module 14 that reside in one quadrant are preferably mirror images of the contact pairs in the same module that reside in the other quadrant. For example, module 14*a* in FIG. 3 has contact pairs in quadrants Q1 and Q4. Contact pairs in module 14*a* that are in quadrant Q1 are mirror images of the contact pairs in quadrant Q4. Other arrangements are also possible. In an appropriate situation, the contact in one quadrant could be rotated 90° to the contacts in the adjacent quadrant.

Area L1 is generally occupied by the ground plane member 20 for single ended applications. Thus, the ground plane member 20 forms a ground and a shield through the center of the connector 10 between the signal contacts 32 in the two modules 14*a*, 14*b* closest to the ground plane member. For example, the top second connection end 24*a* is located between the mating ends 75*a*, 75*a* of the two top signal contacts 32 on opposite sides of the ground plane member. Area L2 is generally occupied by the module ground contacts 34*a* for single ended applications. Thus, the module ground contacts 34*a* form both grounds and shields in a path generally through the center of the connector 10 between the signal contacts in each respective module 14 closets to the module ground contact 34*a*. For example, the mating ends 75*b*, 75*b* of the two middle signal contacts 32 on opposite sides of each module ground contact 34*a* and their intermediate portions 77 (see FIG. 2 will have the module ground contacts 34*a* therebetween. With this arrangement the ground contacts 34*a* and ground plane member 20 form a general cross-shaped ground and shield between the four quadrants Q1, Q2, Q3, Q4, but which still allows for 90 offset connection possibilities with the mating electrical connector pin header. Ground plane 20, ground contacts 34*a* and ground contacts 34 form a pseudo-coaxial structure around each signal contact 32. Clearly, therefore, the signal contacts 32 are preferably single ended signal contacts.

FIG. 4 is a front elevational view of a mating electrical connector or header 100 adapted to be connected to the receptacle connector 10. In particular, the connector 100 is a pin header connector which is fixedly connectable to an electrical component, such as a printed circuit board. The connector 100 includes a housing 102, ground contacts 104, associated signal contacts 106, and ground shields 108. The housing 102 includes a receiving area 110 for receiving the mating face 45 of the receptacle connector 10. The ground contacts 104 have male pin sections 112. The signal contacts 106 have male pin sections 114. When the two connectors 10,100 are properly connected to each other, the pin section 112, 114 extend into the lead-ins 59 and make electrical contact with the ground contacts 34 and signal contacts 32, respectively. The mating connector 100 may also comprise additional ground contacts 104*a*. The additional ground contacts 104*a* do not have associated or paired respective signal contacts as the other ground contacts 104 but help create a pseudo-coaxial structure. In this embodiment the additional ground contacts 104*a* are arranged in a general cross-shaped pattern as illustrated by area L3. The male pin sections of the additional ground contacts 104*a* are adapted to make electrical contact with the ground contacts 34*a* in area L2 and ground plane member 20 in area L1 shown in FIG. 3. In alternate embodiments other types of suitable mating connection and/or contacts could be provided.

Figure 5:
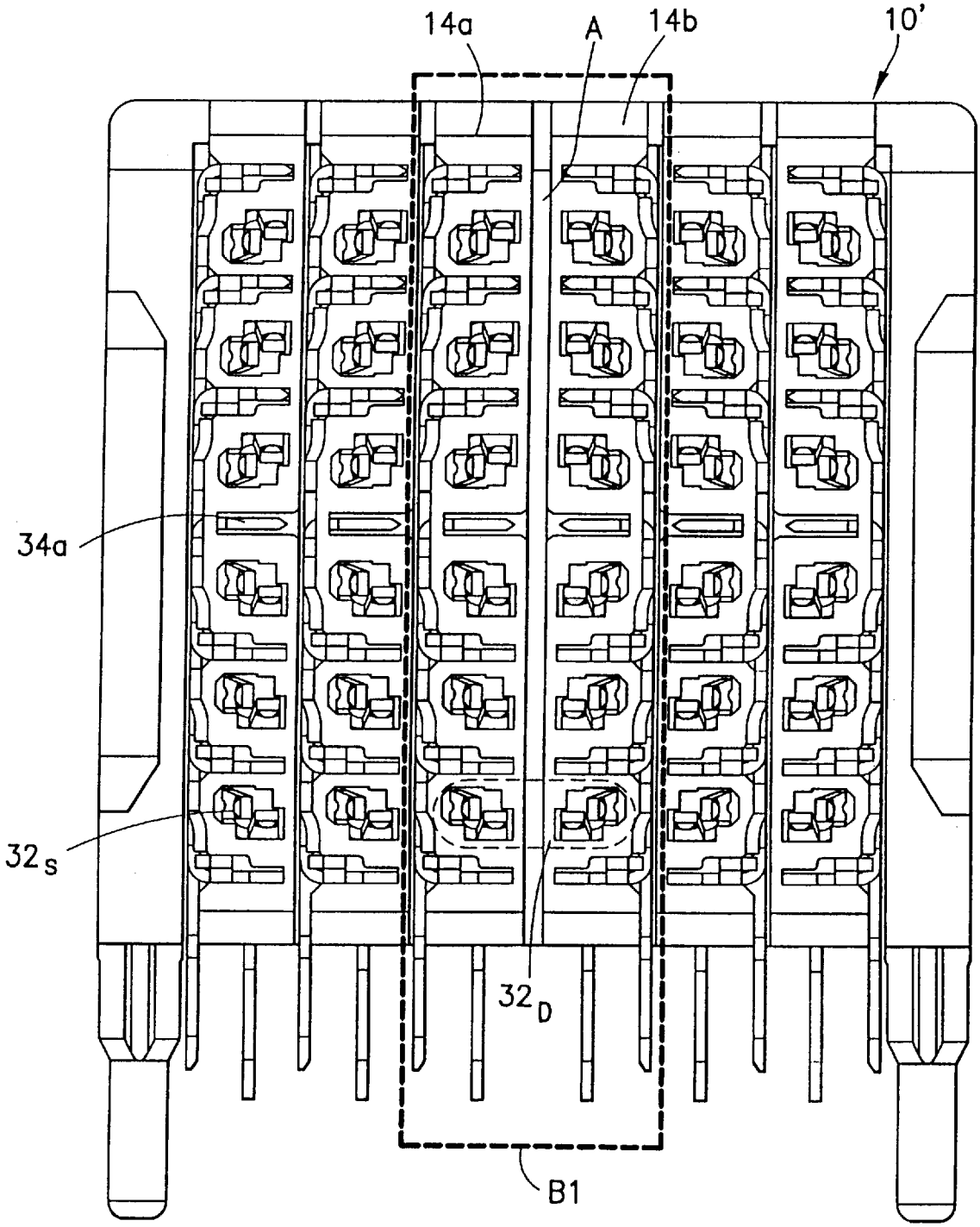
FIG. 5 is a front elevational view similar to FIG. 3 of an alternate embodiment of the present invention.
Figure 6:
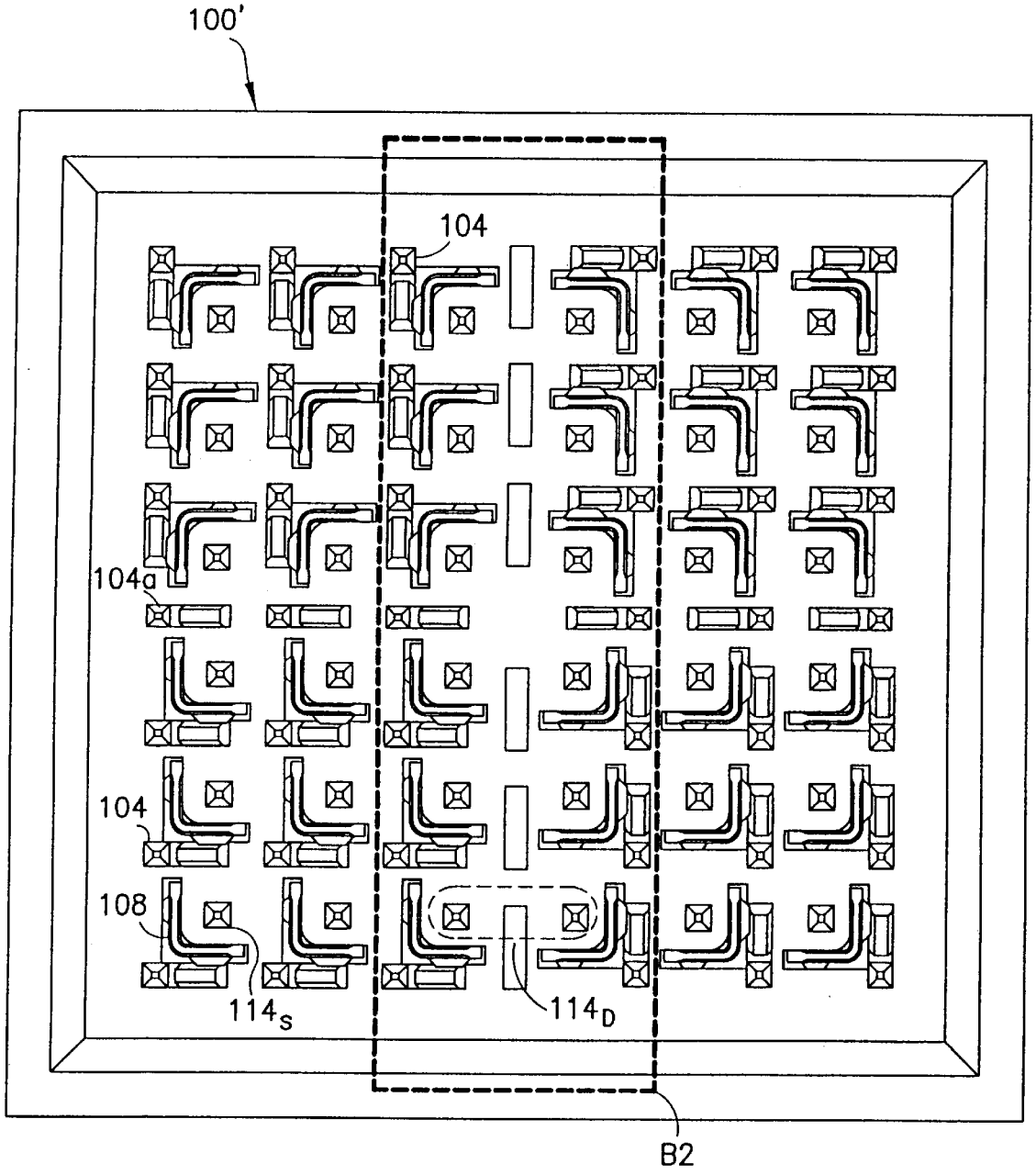
FIG. 6 is a front elevational view of a mating electrical connector for use with the connector shown in FIG. 5.

Referring now also to FIG. 5 an alternate embodiment of the present invention will be described. FIG. 5, similar to FIG. 3, shows the receptacle connector 10' with its front housing member removed. In this embodiment the connector 10' is substantially identical to the connector 10, but does not include the ground plane member 20. Thus, a shield is not provided between the signal contacts 32 in the two modules 14*a*, 14*b*closest to each other at the center of the connector 10'. Area A is empty, allowing signal contacts 32 in modules 14*a,b* to be driven as differential pairs. With this embodiment the connector 10' can comprise both single ended signal contacts 32*s* as well as differential pair signal contacts 32D. More specifically, area B1 forms six differential pair signal contacts; each pair comprising one signal contact from each of the two closest modules 14*a*, 14*b*. The rest of the signal contacts (located outside area B1) can remain single ended signal contacts because of the shielding provided by the ground contacts 34, 34*a*. The ground contacts 34, 34*a* in area B1 also prevent signal interference between adjacent pairs of the differential pair signal contacts $32_D$ and also between the differential pairs $32_D$ and the single ended contacts $32_s$. FIG. 6 shows a mating connector 100' similar to the mating connector 100 shown in FIG. 4 for use with the connector 10'. As can be seen, the center column of additional ground contacts has been omitted. Thus, area B2 is formed which can use the six pairs of signal contacts $114_D$ as differential pair signal contacts. The remaining signal contacts $114_s$ outside area B2 can be used as single ended signal contacts because of the ground shields 108 and ground contacts 104, 104*a*. In an alternate embodiment a ground plane member similar to member 20 could be located in area A, but have all of its second connection ends 24 removed.

Figure 7:
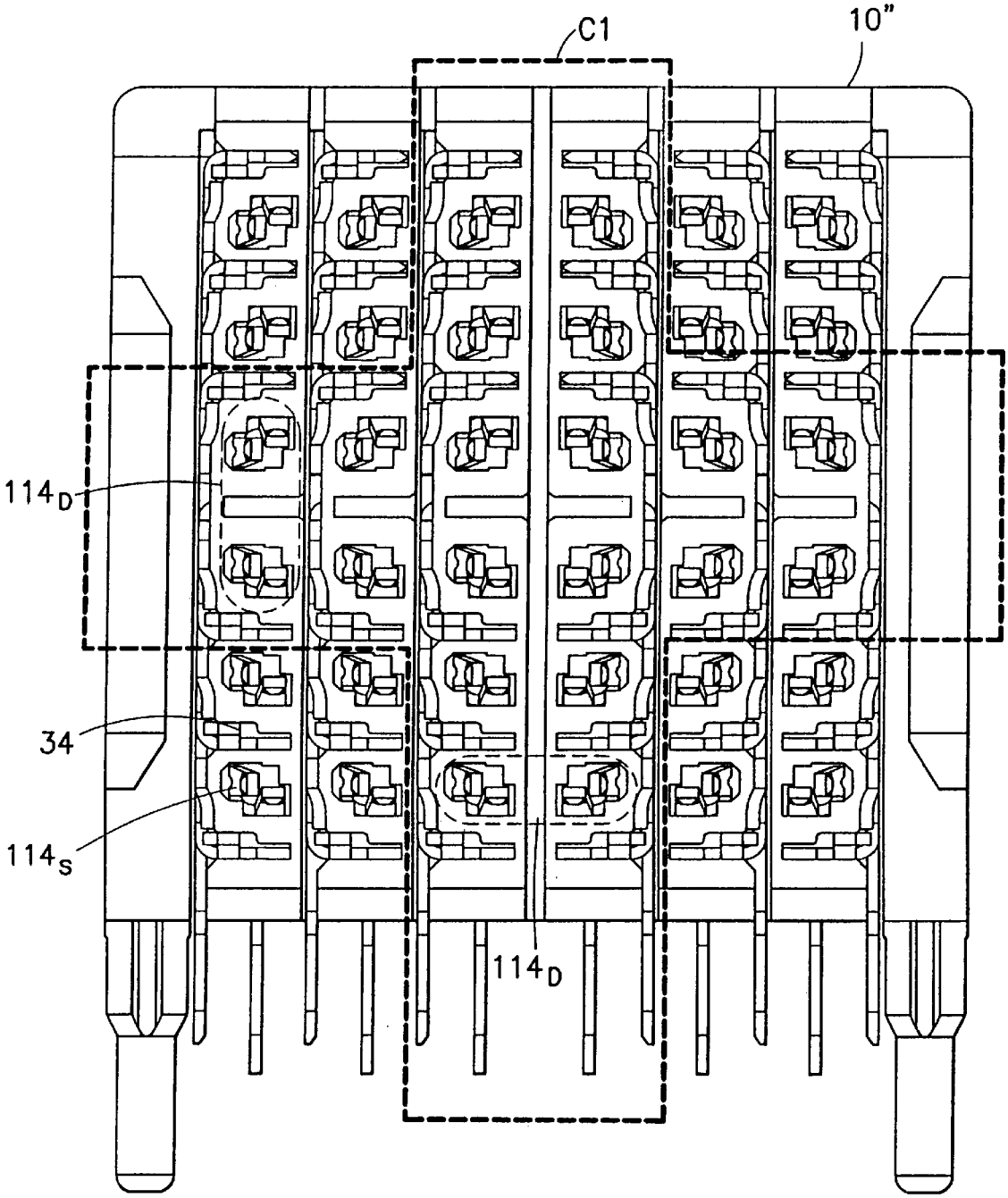
FIG. 7 is a front elevational view similar to FIG. 3 of another alternate embodiment of the present invention.
Figure 8:
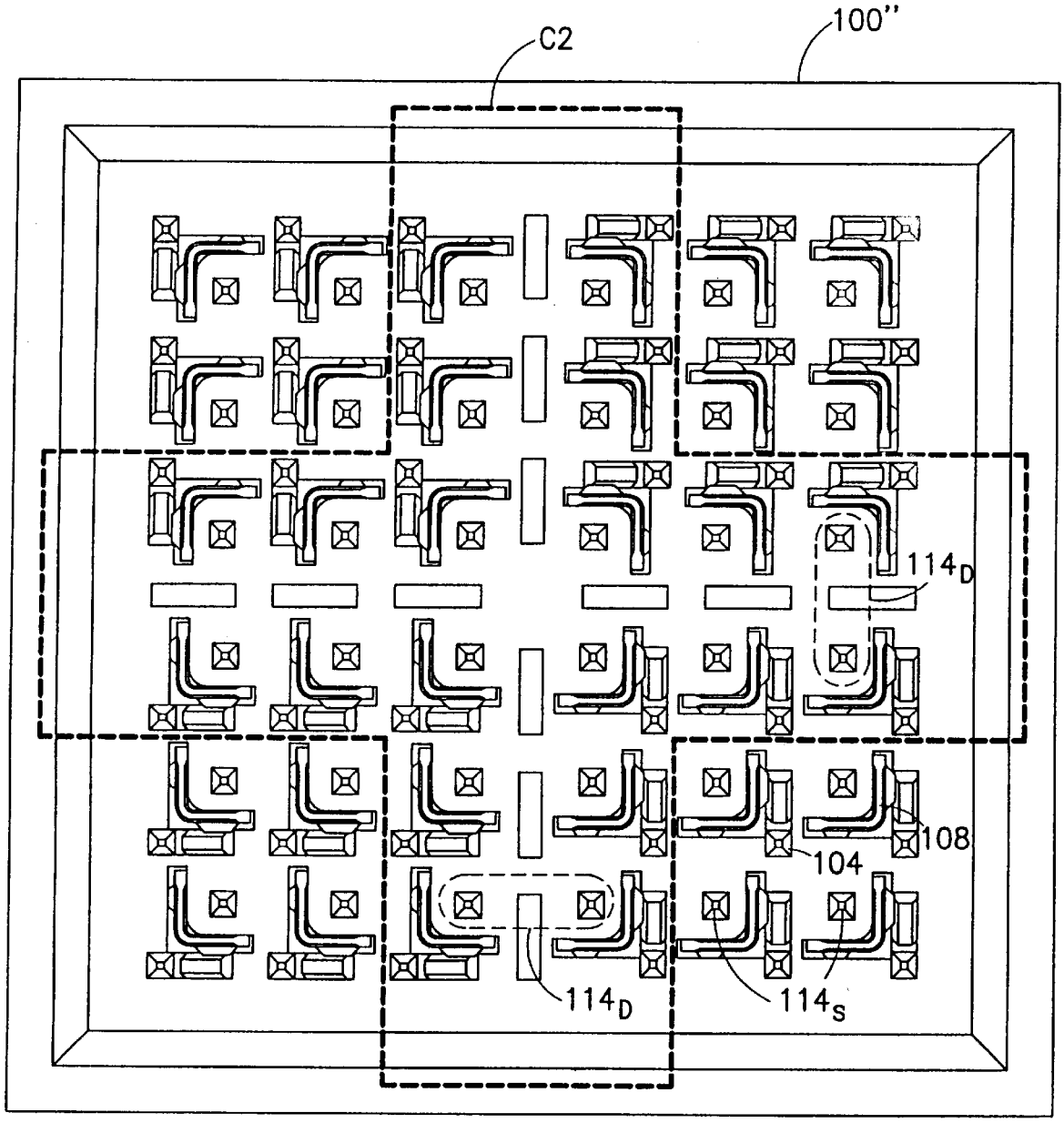
FIG. 8 is a front elevational view of a mating connector for use with the connector shown in FIG. 7.
Figure 9:
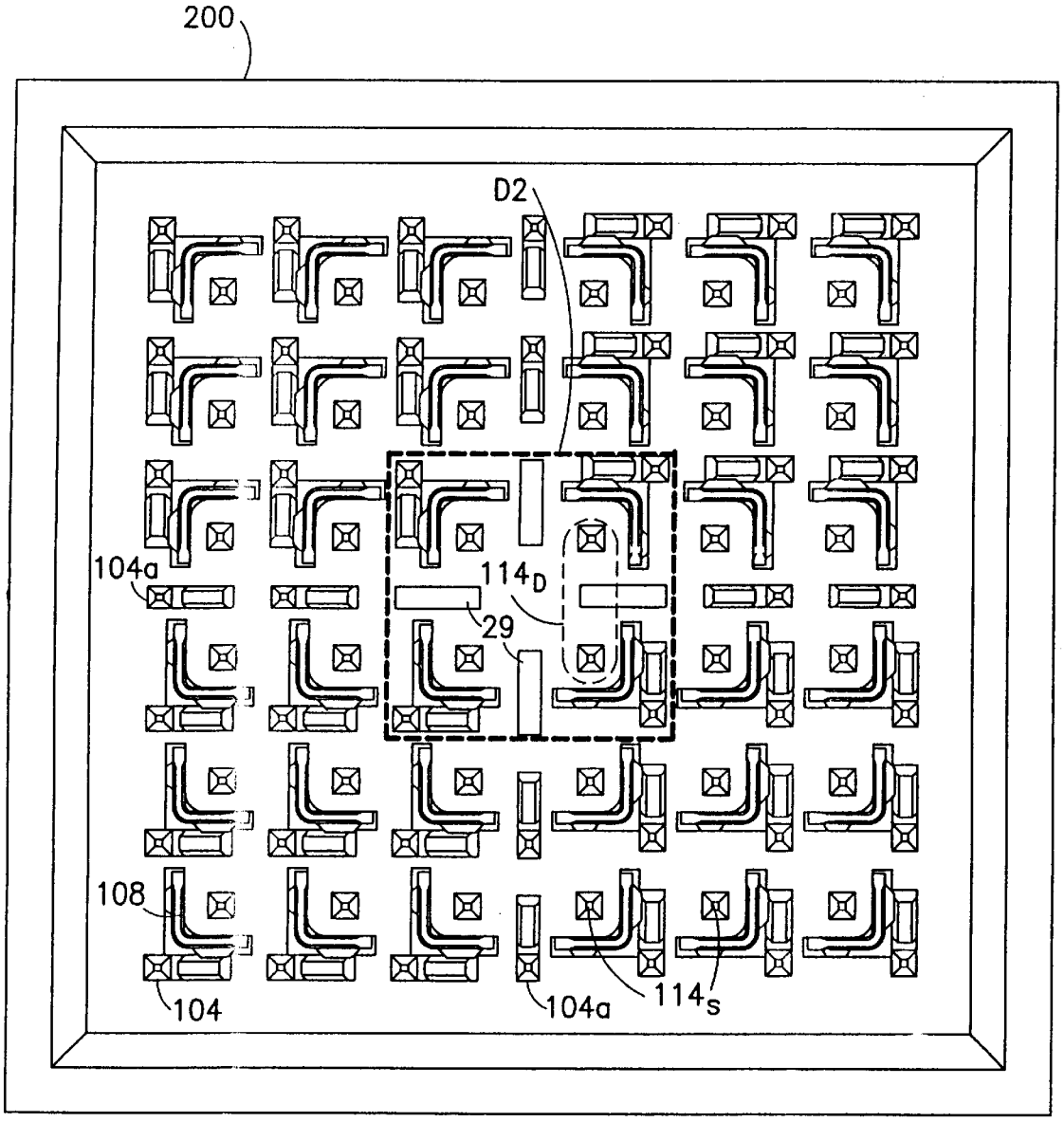
FIGS. 9–12 are front elevational views of alternate embodiments of mating header connectors for use with appropriately configured alternate embodiment receptacle connectors.

Referring now also to FIG. 7, another alternate embodiment will be described. In this embodiment the receptacle connector 10" is substantially the same as the receptacle connector 10' shown in FIG. 5 except that the connector 10" has all the center ground contacts 34*a* omitted. Thus, area C1 is formed which comprises ten differential pair signal contacts $114_D$. Area C1 has a general cross-shape, but any suitable shape could be provided depending upon which ones of the center ground contacts 34*a* and/or second connection ends 24 are omitted. The signal contacts $114_s$ outside area C1 can be used as single ended signal contacts because of the shielding provided by the ground contacts 34. Referring also to FIG. 8 a mating connector 100" is shown similar to the mating connector 100' shown in FIG. 6 for use with the connector 10". As can be seen, both the center column and center row of additional ground contacts have been omitted. Thus, area C2 is formed which can use the ten pairs of signal contacts. The remaining signal contacts 114D (i.e. those not used as differential pair signal contacts) outside area C2 can be used as single ended signal contacts 114*s* because of the ground shields 108 and ground contacts 104.

FIGS. 9–12 show other alternate embodiments of the mating connectors, it being understood that their respective receptacle connectors would be correspondingly configured to mate similar to the connectors 10 and 100, 10' and 100', and 10" and 100". The receptacle connectors would have the appropriate second connection ends 24 of the ground plane member 20 removed and/or the appropriate center ground members 34*a* omitted corresponding to the empty apertures 29 in the housing of the mating connector. In the embodiment shown in FIG. 9, the mating connector 200 is similar to the mating connector 10 shown in FIG. 4, but has four empty apertures 29. This forms an area D2 having differential pair signal contacts $114_D$. The contacts 114*s* outside the area D2 can be used as single ended signal contacts due to the shielding provided by ground shields 108 and ground contacts 104, 104*a*.

Figure 10:
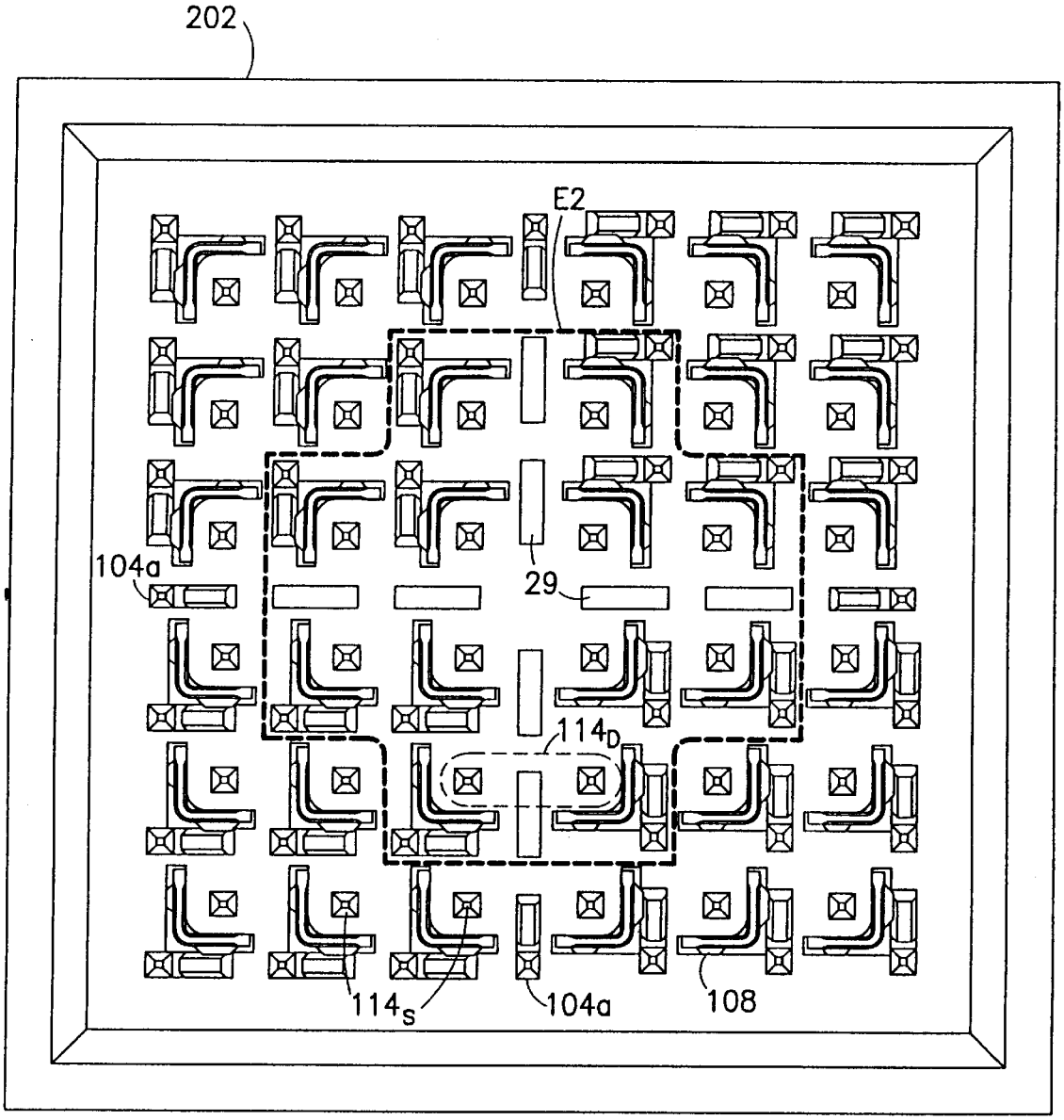

In the embodiment shown in FIG. 10, the mating connector 202 is similar to the mating connector 10 shown in FIG. 4, but has eight empty apertures 29. This forms an area E2 having differential pair signal contacts $114_D$. The contacts 114*s* outside the area E2 can be used as single ended signal contacts due to the shielding provided by ground shields 108 and ground contacts 104, 104*a*.

Figure 11:
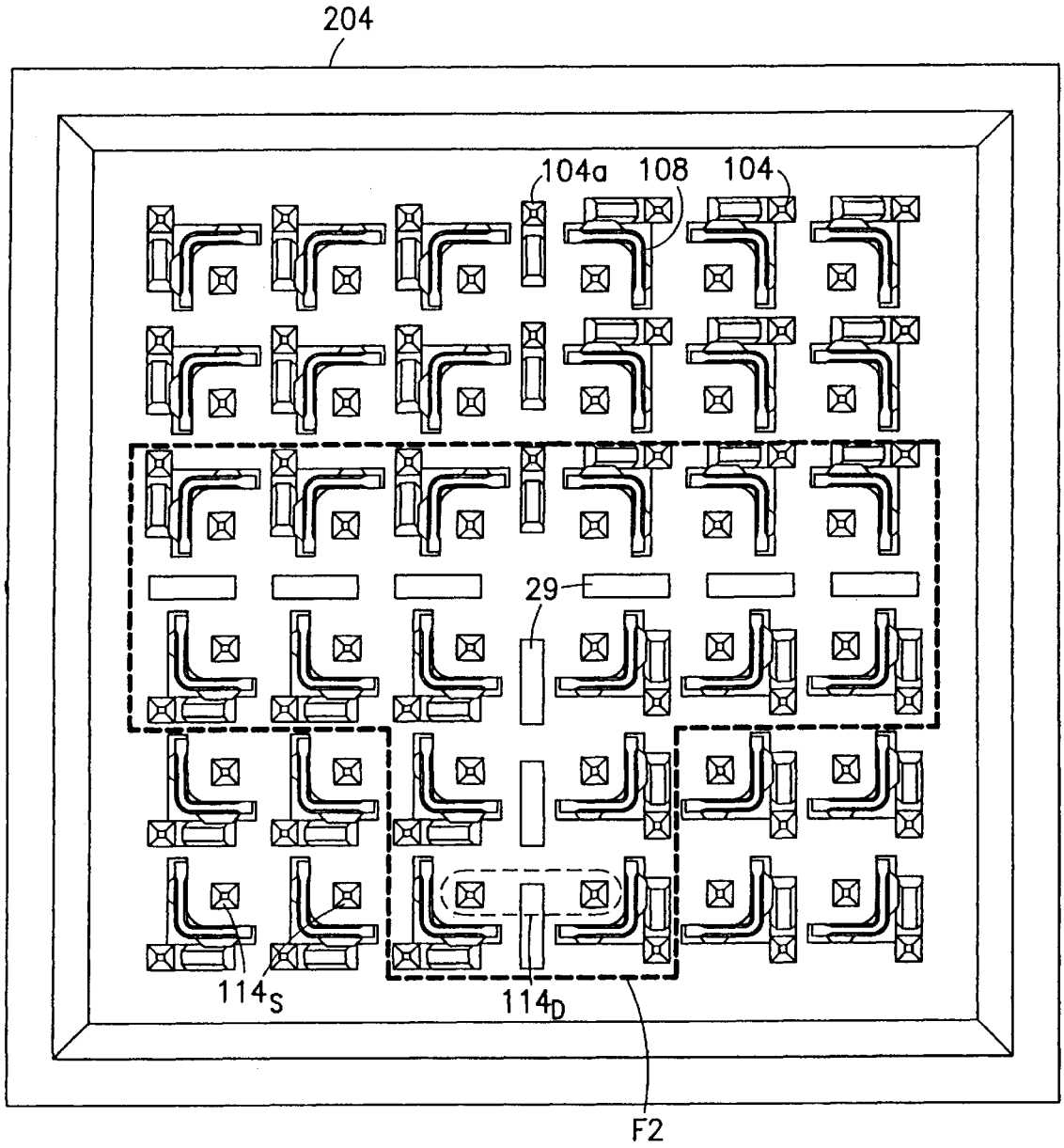

In the embodiment shown in FIG. 11, the mating connector 204 is similar to the mating connector 10 shown in FIG. 4, but has nine empty apertures 29. This forms an area F2 with a general "T" Shape having differential pair signal contacts $114_D$. The contacts 114*s* outside the area F2 can be used as single ended signal contacts due to the shielding provided by ground shields 108 and ground contacts 104, 104*a*. This embodiment also illustrates that the patterns for the differential pair signal contacts and single ended signal contacts can be asymmetric. In such an asymmetric arrangement, the mating connectors should mate in only one orientation.

Figure 12:
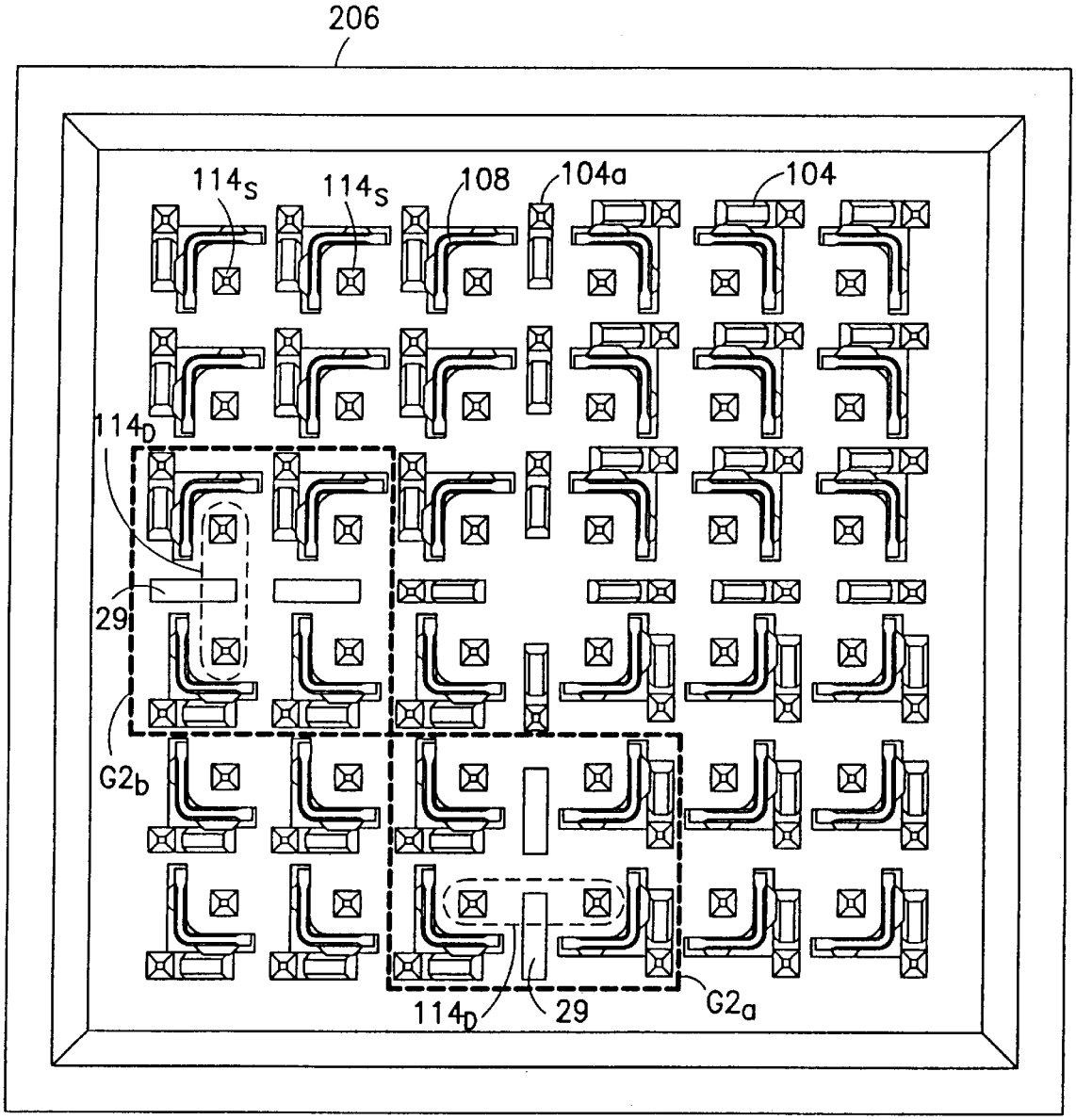

In the embodiment shown in FIG. 12, the mating connector 206 is similar to the mating connector 10 shown in FIG. 4, but has four empty apertures 29 provided as two spaced apart groups. This forms two areas $G2_a$, $G2_b$ having differential pair signal contacts $114_D$. The contacts 114*s* outside the areas $G2_a$, $G2_b$ can be used as single ended signal contacts due to the shielding provided by ground shields 108 and ground contacts 104, 104*a*. This embodiment illustrates that the differential pair contacts can be provided, as more than one group or area (perhaps spaced from each other) and do not need to pass through the center of the connector.

Figure 13:
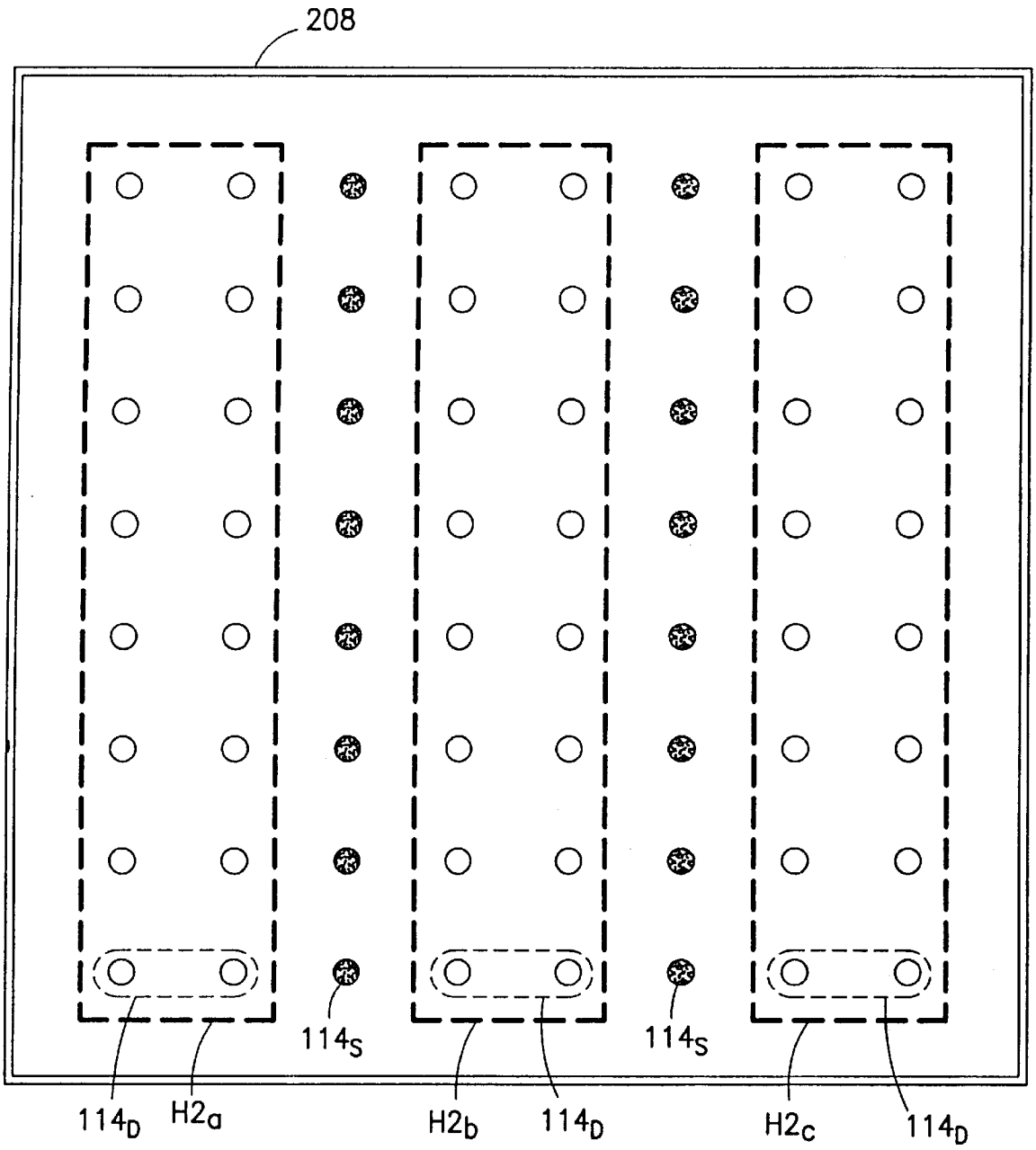
FIG. 13 is a schematic diagram of a signal contact layout for another alternate embodiment of a mating header connector.

Referring now to FIG. 13, a schematic diagram of a signal contact layout for another alternate embodiment is shown. In this embodiment the connector 208 includes an array of 8×8 signal contacts. However, any suitable number or array shape and size could be provided. The ground contact layout and ground shields are not shown merely for the sake of clarity. This arrangement is achieved by allowing the placement of ground plane 20 at locations other than a central position. In this embodiment the connector 208 includes three groups ($H2_a$, $H2_b$, $H2_c$) which are separated by two groups of single ended signal contacts $114_s$. In other words, ground planes 20 are place between: (1) group $H2_a$ and the row of single ended contacts, $114_s$; (2) the row of single ended contacts 114*s* 4 and group $H2_b$. This pattern continues across the connector. In alternate embodiments the layout or pattern for the signal contacts could be varied such as not having any signal ended signal contacts, having only one group of single ended signal contacts, having more than three groups of differential pair signal contacts (spaced from each other and/or not spaced from each other), and having symmetric and/or non-symmetric patterns.

Figure 14:
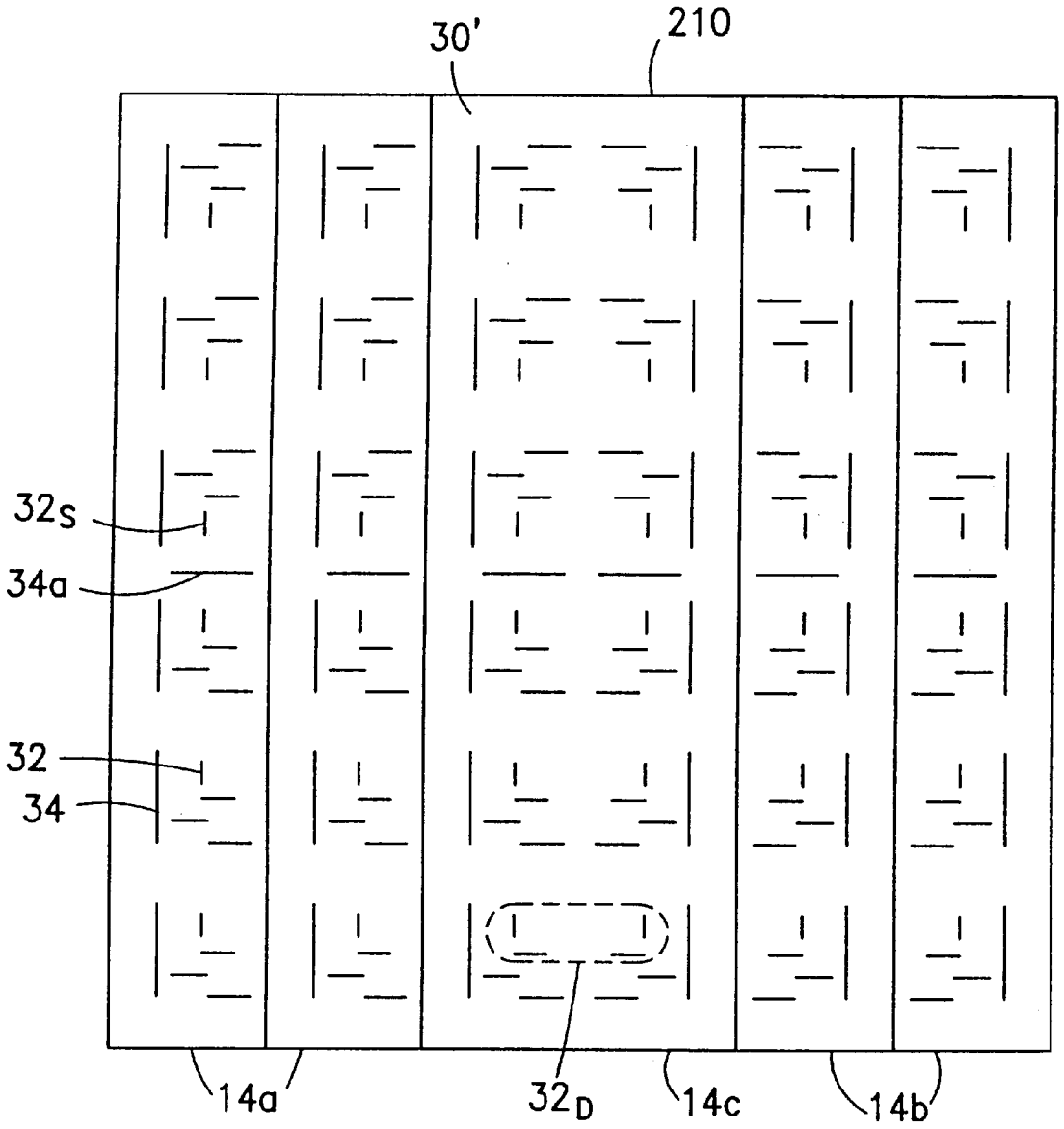
FIG. 14 is a schematic view of a contact module layout for another alternate embodiment of a receptacle connector.

Referring now to FIG. 14, a schematic illustration of another alternate embodiment of the receptacle connector is shown. In this embodiment the connector 210 comprises five modules or wafer subassemblies 14*a*, 14*b* and 14*c*. The modules form a 6×6 array of paired signal and ground contracts 32, 34 as well as additional ground contacts 34*a*. However, in this embodiment the connector only has two left-hand modules 14*a* and two right hand modules 14*b*. The left and right hand modules 14*a*, 14*b* each comprise a 1×6 array of only single ended signal contacts 32*s*. In an alternate embodiment the left and right hand modules 14*a*, 14*b* could also form differential pair signal contacts. The center module 14*c* comprises a 2×6 array of associated signal and ground contacts in a common wafer housing 30' forming six differential pair signal contacts 32D. Thus, the single module 14*c* comprises differential pair signal contacts in a common housing. In an alternate embodiment the center module 14*c* could include single ended signal contacts, such as when the housing 30' is adapted to receive a ground plane member.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A method of manufacturing electrical connectors having both single ended signal contacts and differential pair signal contacts comprising the steps of:

providing at least two first pairs of single ended signal contacts and respectively paired ground contacts for each of the first pairs of signal contacts in a first subcomponent wafer assembly;

providing at least two second pairs of differential pair signal contacts and respectively associated ground contacts for each of the second pairs of signal contacts in a second subcomponent wafer assembly; and connecting the first subcomponent wafer assembly to the second subcomponent wafer assembly to form the electrical connector.

2. A method of manufacturing an electrical connector comprising steps of:

providing a housing having first contact receiving areas and second contact receiving areas, positioning paired signal and ground contacts in the first contact receiving areas; and selectively positioning additional ground contacts in the second contact receiving areas, wherein at least one of the second contact receiving areas does not have an additional ground contact located therein such that two of the paired signal contacts, each on opposite sides of the at least one second contact receiving area, form a differential pair of high speed signal transmission contacts.

3. A method as in claim 2 wherein the second contact receiving areas include a center row, and wherein equal numbers of the paired contacts are positioned on opposite sides of the center row.

4. A method as in claim 3 wherein the second contact receiving areas include a center column, and equal numbers of the paired contacts are positioned on opposite sides of the center column.

5. A method as in claim 2 wherein the step of providing a housing comprises providing multiple wafer housings and connecting the wafer housings to each other in series.

6. A method as in claim 5 wherein the step of positioning additional ground contacts comprises locating a ground plane member between two of the wafer housings.

7. A method of manufacturing an electrical connector, the method comprising the steps of:

providing a housing having electrical contact receiving areas;

connecting electrical contacts to the housing in the contact receiving areas, the electrical contacts comprising paired signal and ground contacts;

providing additional ground contacts in the housing separate from the paired signal and ground contacts; and arranging the additional ground contacts relative to the paired contacts to divide the paired contacts into subdivisions of equal numbers of the paired contacts, wherein the subdivisions comprise four quandrants.

8. The method of claim 7, wherein the step of arranging the additional ground contacts further comprises the step of arranging the additional ground contacts into a general cross shape.

9. The method of claim 7 wherein the step of arranging comprises arranging the additional ground contacts in a row of horizonatally centered and a column of vertical centered connection areas at a mating connection area.

10. The method of claim 7 further comprising the step of arranging the subdivisions and the additional ground contacts in a manner to allow for multiple relative orientation connections of a mating connector.

11. The method of claim 7 further comprising the steps of:

forming subassembly wafers comprising a portion of the housing, the contact pairs and some of the additional ground contacts; and sandwiching the subassembly wafers together to form the electrical connector.

12. The method of claim 11 wherein the step of sandwiching includes sandwiching at least one of the additional ground contacts between two of the subassembly wafers.

13. The method of claim 1 further comprising the steps of:

selectively locating additional ground contacts between two of the first pairs of signal contacts, wherein at least two of the second pairs of signal contacts do not have the additional ground contacts therebetween such that the signal contacts of the two second pairs form a differential pair of the high speed signal transmission signal contacts and signal contacts of the two first pairs form single ended signal transmission signal contacts.

* * * * *